US009683790B2

(12) United States Patent
Leonard

(10) Patent No.: US 9,683,790 B2
(45) Date of Patent: Jun. 20, 2017

(54) TEXTILE THREAD OR FIBRE

(76) Inventor: Philip Noel Leonard, Chepstow (GB)

( * ) Notice: Subject to any disclaimer, the term of this patent is extended or adjusted under 35 U.S.C. 154(b) by 436 days.

(21) Appl. No.: 14/114,430

(22) PCT Filed: Apr. 30, 2012

(86) PCT No.: PCT/GB2012/050951

§ 371 (c)(1),
(2), (4) Date: Jan. 15, 2014

(87) PCT Pub. No.: WO2012/146944

PCT Pub. Date: Nov. 1, 2012

(65) Prior Publication Data

US 2014/0126137 A1 May 8, 2014

(30) Foreign Application Priority Data

Apr. 28, 2011 (GB) ..... 1107152.9

(51) Int. Cl.

| | |
|---|---|
| ***F28F 1/00*** | (2006.01) |
| ***D01D 5/24*** | (2006.01) |
| ***D01D 5/247*** | (2006.01) |
| ***D02G 3/44*** | (2006.01) |
| ***F25D 7/00*** | (2006.01) |

(52) U.S. Cl.

CPC ..... *F28F 1/00* (2013.01); *D01D 5/24* (2013.01); *D01D 5/247* (2013.01); *D02G 3/441* (2013.01); *D02G 3/448* (2013.01); *F25D 7/00* (2013.01); *Y10T 428/2915* (2015.01); *Y10T 428/2925* (2015.01)

(58) Field of Classification Search

USPC ..... 361/679.31; 428/365, 371; 62/31.5

See application file for complete search history.

(56) References Cited

U.S. PATENT DOCUMENTS

| | | | | |
|---|---|---|---|---|
| 4,293,418 | A | 10/1981 | Fujii et al. | |
| 5,297,591 | A * | 3/1994 | Baurmeister | B01D 63/02 139/383 R |
| 2009/0030504 | A1 * | 1/2009 | Weber | A61L 31/022 623/1.42 |
| 2010/0031428 | A1 | 2/2010 | Paull | |

FOREIGN PATENT DOCUMENTS

| | | |
|---|---|---|
| JP | 01020319 | 1/1989 |
| JP | 2005298986 | 10/2005 |
| WO | 2006033118 | 3/2006 |

OTHER PUBLICATIONS

International Search Report for WO2012/146944, issued by European Patent Office on Jan. 18, 2013.

* cited by examiner

*Primary Examiner* — Lynda Salvatore
(74) *Attorney, Agent, or Firm* — Dinsmore & Shohl LLP

(57) ABSTRACT

Aspects of the present invention relate to a textile fiber, thread or yarn. The fiber, thread or yarn is generally for production into a fabric. Alternative aspects are described for achieving a cooling effect, energy harvesting, heating, energy generation, energy emission, and others.

21 Claims, 7 Drawing Sheets

TEXTILE THREAD OR FIBRE

Aspects of the present invention relate to a textile fibre or thread or yarn. The fibre, thread or yarn is generally for production into a fabric.

One aspect of the present invention relates to a textile thread or fibre that may be utilised for achieving cooling effects.

In hot climates or hot conditions, the normal human reaction is to remove clothing. In a number of circumstances this may be neither practical nor desirable. For example, clothing which has an important or desired effect, such as business suits, company uniform, protective industrial clothing or fashion clothing may not be possible to be removed when the wearer is hot. Furthermore, a member of the military may not wish to remove camouflage, camouflage clothing or protective clothing. A further example is that removal of clothing may make the skin vulnerable to both damage in sun light or other harmful effects such as nuclear, biological, chemical or animal/insect attacks.

It is also appreciated that textile threads or fibres are used for other applications such as in a cloth or fabric used for seats, cloth or fabric used for chilling purposes which may be for medical treatment, cooling of medicines or the cooling of chilling of food or drinks Other examples are the interior of safety helmets or other head gear, bed sheets or mosquito nets. It is clearly beneficial if such textile threads or fibres used to produce a fabric for any of these purposes could achieve a cooling effect to the wearer or user of the item to be cooled.

According to the first aspect of the present invention there is a textile thread or fibre configured to enable fluid flow therethrough, the textile thread or fibre being an elongate member having a cavity portion therein, wherein a wall of the elongate member includes one or more apertures therein, thereby providing a fluid flowpath from the cavity portion through the wall of the elongate member.

The fluid flow may be a liquid or a gas.

The provision of a cavity allowing a liquid or gas to pass therethrough will remove heat and will provide a cooling effect to the wearer or user. This will make the user more comfortable and will make the removal of clothing either less of a necessity or entirely unnecessary. Such a person is likely to be more productive, more efficient, work more safely, may have less down time due to illness etc.

Beneficially a gas, and in particular air, can travel through at least a portion of the cavity thus transporting heat away from the heated area. The cavity may be the core of the elongate member, and is preferably elongate.

The cavity and preferably the core is beneficially tubular although a skilled person would understand that other profiles may be achieved. The profile and dimensions of the cavity may also change throughout its length, for example to retain additional components.

The one or more apertures in the wall of the elongate member may define one or more ports or ducts therein. Such one or more apertures enable heated air to escape the cavity and will allow cooler air to enter the cavity. Ingress and egress of air will be affected and effected by the natural or forced movement of the item of clothing or item made of or incorporating the thread.

The elongate member is beneficially made of a polymer, the polymer having sufficient rigidity to generally maintain the elongate member and the cavity and thus the elongate member being substantially hollow when the thread is in use, and also be sufficiently flexible to enable movement and deformation of the textile thread and any fabric made up of one or more individual threads. The elongate member is in one embodiment beneficially permeable in order to allow air ingress and air egress. The elongate member is beneficially made of polyester.

There are beneficially one or more individual fibres disposed around the elongate member, which are beneficially wound in a helical configuration. Such a configuration is particularly suitable for strength in particular and can be achieved through a number of spinning mill processes such as core wrapping. Such technology has been available since approximately 1831 and it is widely used throughout the world in particular for wrapping fibrous material around a core of various materials. It is possible to wrap fibrous material around compounds of a somewhat fragile nature. Multiple strands of reinforcing material may be wrapped helically in opposite directions as the core member passes through the machine and the fibrous material is fed from stock cartons secured on simple supporting frames which are rotated about the elongate member.

The one or more apertures are beneficially configured to extend in series helically around the elongate member. Such an aperture configuration is beneficial as this enables a relatively large percentage of the wall of the elongate member to be open to the external environment therefore enabling a large flow of gas ingress or gas egress whilst also maintaining strength of the elongate member.

The thread may further comprise a fan arrangement or impeller arrangement or similar means of providing a forced flow configured to push air through the cavity. Such an arrangement may be located in the cavity.

A heating element may be provided in communication with the gas present in the cavity. This may provide the further advantage of ensuring that heat energy is removed from adjacent the hot heating element and may transfer to an area in, for example, an item of clothing, where heating of the user is required.

The thread may further comprise a plurality of elements located in the cavity of the elongate member, wherein the plurality of elements are interconnected or otherwise communicating to form a signal processing system. An example of such a system is described in WO02/084617 which describes a system that may comprise, for example, a personal computer system, a personal telecommunication transmitter/receiver system or a personal television and/or radio system.

The one or more elements may be elongate in shape and are aligned lengthways or helically in the cavity. Other configurations may be, for example, serpentine, meander or Aztec pattern as examples only.

The one or more elements are beneficially affixed internally or embedded into the wall of the elongate member.

The elongate member is beneficially made of a polymer, wherein the polymer is beneficially polyvinyl chloride or polyester. The polymeric elongate member is flexible and is relatively easy to manufacture by known techniques.

An energy conversion device may be at least partially positioned in the cavity, wherein the energy conversion device preferably comprises a turbine. The turbine beneficially comprises a rotor and a stator and a transfer means for transferring the electrical energy to a predetermined location, preferably a charge storage device, but alternatively can be transformed for immediate use by an energy consuming arrangement.

The turbine preferably comprises a plurality of blades mounted onto the rotor. A control arrangement is preferably provided for enabling energy release from the charge storage device.

The administering of a liquid or a gas either to a person or to an area is normally achieved through the spraying of an aerosol or application of a liquid to a person for example. As an example, insect repellent is provided often in a liquid form which is sprayed over a person in order to deter insect bites. However, the user therefore requires that they have the insect repellent to hand in the event that it is required. Alternatively, a fabric that is used on a regular basis such as the seat of a vehicle becomes dirty over time and is likely to give off an unpleasant odour. The seat then needs to be cleaned with a detergent which has a more pleasant scent.

The cavity portion may in one embodiment include a fluid therein.

The fluid may comprise a liquid refrigerant or coolant, an insect repellent, or a medication or a cleanser depending on the requirements of the textile thread. The cleanser may be used to clean the cavity if use requirements are changed.

A valve arrangement is preferably provided to enable and control release of the fluid from the cavity portion through the one or more apertures in the elongate member. A control arrangement is beneficially provided to control actuation of the valve. The valve may be arranged to be actuated by a predetermined pressure or temperature in the cavity, or by control provided by an invention such as described in WO02/084617 for example.

The one or more apertures are provided in the longitudinal wall of the elongate member.

A duct is preferably provided for enabling fluid flow from the aperture in the wall of the elongate member to the ambient, the duct configured to project at least partially transversely relative to the longitudinal length of the elongate member. A plurality of ducts may be provided. The one or more ducts preferably project substantially transversely relative to the longitudinal length of the elongate member.

There are significant advantages associated with this aspect of the present invention. The desired liquid can be provided in the textile thread or fibre and released as required, thereby providing cooling, medical treatment or pest repellent as examples only.

The cooling of a textile thread or fibre which may be incorporated into a fabric, for example, may also be achieved following an alternative technique.

According to a second aspect of the present invention there is a textile thread comprising one or more textile fibres of a first material wrapped or otherwise disposed around one or more textile fibres of a second material.

The purpose of such a configuration is in order that the second textile thread may act to wick, via capillary action, moisture away from, for example, the wearer of a garment to a location in which evaporation of the liquid may occur.

The second material beneficially has greater liquid capillary motion properties than the first material, meaning that liquid can be transferred through the second textile thread at a greater rate. Accordingly, the outward appearance of the garment comprising the textile threads hides the fact that wicking materials are present enabling fluid to be wicked away.

Preferably, the first material is at least partially wrapped around an elongate member (beneficially in a helical or spiral configuration), the elongate member having a cavity therein.

Preferably, at least a portion of the one or more second fibre (of the second material) is at least partially located in the cavity of the elongate member.

Preferably, at least one or more of the second fibre is embedded in a wall of the elongate member.

A turbine may be provided comprising a rotor and a stator and a transfer means for transferring the electrical energy to a predetermined location, for storage or use. Accordingly, flow of gas such as air is enabled through the cavity thus improving the wicking effect. At least a portion of the one or more second fibres is at least partially located in the cavity of the elongate member. Even more beneficially, at least a portion of the second fibre is embedded in a wall of the elongate member. The one or more fibres of the second material are beneficially arranged in a helical or spiral configuration about the elongate member. Such configuration increases the surface area of the second thread thereby improving wicking capabilities.

The elongate member beneficially comprises one or more apertures therein for release of air and/or vapour from the cavity.

The first material and the second material are beneficially different, and the second material beneficially has increased capability of capillary motion of fluid therethrough compared to the first material. The second material beneficially comprises a polymer, and in particular beneficially comprises a polyester.

The benefits of a textile thread or fibre according to this aspect of the present invention are significant as the second material is able to wick moisture away from one area of the textile thread to another and therefore a particularly suitable application would be a garment for wearing where, for example, the textile thread is able to wick moisture away from, for example, an underarm area of the garment to a second location such as on the arm where evaporation of the moisture can take effect.

A fan arrangement is beneficially provided and at least partially located in the cavity of the elongate member thus improving wicking of moisture.

It is beneficial to provide power for embodiments of the present invention, and furthermore energy may be harvested from various sources and used or stored as required.

According to a third aspect of the present invention there is beneficially provided a textile thread or fibre comprising an elongate member having an elongate cavity therein and an energy conversion device at least partially encapsulated in the cavity.

The energy conversion device preferably comprises a turbine.

As fluid such as gas or liquid, and preferably air passes through the cavity, this air activates the turbine causing rotary movement. The turbine beneficially comprises a rotor and a stator and a transfer means for transferring the electrical energy to a predetermined location. The transfer means may comprise an electrically conductive cable. The predetermined location is preferably a charge storage device and the turbine beneficially comprises a plurality of blades mounted onto the rotor.

A control arrangement may be provided enabling control of the release of electrical energy from the charge storage device and is optionally configured to activate or deactivate the turbine, as described with reference to WO02/084617.

A further aspect of the present invention is designed to provide a cooling effect or a heating effect as desired to a textile thread or fibre. Accordingly, heat may be removed or supplied to a part of or a whole textile thread or fibre.

The Peltier effect and its inverse, the Seebeck effect together with the Thomson effect are based on the same scientific principles. The use of such effects is provided by passing a current through the junction of two different conductors and a temperature change is thus achieved. There are no moving parts and no refrigerants and therefore such a system may be termed a solid state cooling system or conversely a solid state heating system which is good for small and quiet applications. There are significant benefits as solid state cooling systems have no moving parts and therefore offer high reliability and low maintenance whilst offering low noise performance. Furthermore, solid state cooling or heating systems are ecologically clean, i.e. no CFC or other types of refrigerants are involved.

According to a fourth aspect of the present invention there is a textile thread or fibre comprising an elongate member having an elongate hollow cavity therein and a circuit at least partly embedded in a wall of the elongate member, the circuit including a junction between a first electrically conducting material and a second electrically conducting material, wherein the second electrically conducting material is different to the first electrically conducting material.

The circuit beneficially comprises a plurality of junctions. At least a portion of the circuit containing the one or more junctions preferably extends around the wall of the elongate member. At least a portion of the circuit preferably extends helically with respect to the longitudinal length of the elongate member. A direct current power source is preferably provided.

The junction preferably comprises opposing plates having the first conducting material and second conducting materials spaced apart therebetween, wherein the first conducting material and second conducting material are in communication with the opposing plates. The first and second conducting materials are preferably doped semi conductors. The semi conductor material preferably comprises bismuth telluride, or other suitable material.

A control arrangement for controlling the current from the power source is preferably provided as described with reference to WO02/084617.

The junctions are preferably in series. An arrangement for selectively bypassing one or more junctions is preferably provided.

A diode arrangement may also be provided to selectively allow current to flow to a junction.

In an alternative embodiment of the present invention, it is beneficial to provide a heating or warming effect to a textile thread or fibre.

According to a fifth aspect of the present invention there is a textile thread or fibre comprising one or more fibres disposed at least partially around a heating element.

The heating element is preferably arranged to be in communication with an electricity supply arrangement. A control means may be provided for controlling the output from the electricity supply arrangement. The electricity supply arrangement may comprise a charge store, and the supply of charge may be achieved from alternative aspects of the present invention, or connections may be provided to obtain energy from an alternative source.

The textile thread or fibre may also include an elongate member wherein the heating element is at least partially secured to the elongate member. One or more fibres may be disposed at least partially around the elongate member. The elongate member is preferably generally hollow defining a cavity therein, and the heating element is at least partially located in the cavity. The heating element is at least partially embedded in a wall of the elongate member in a preferred embodiment. The heating element may alternatively be coiled in or around the elongate member. The heating element may be a metallic or a ceramic material. The heating element may include nickel. The heating element may alternatively include barium titanate or lead titanate.

It is beneficial in order to provide power for alternative embodiments of the present invention and to provide power for a number of purposes to enable a fabric and in particular fibres or threads of a fabric to be configured to enable production of an electrical current which may be stored as an electrical charge.

According to a sixth aspect of the present invention there is a textile thread defined by one or more individual fibres disposed around an element, the element having properties such that when a mechanical stress is applied to the element a voltage is produced across the element, and conversely when a voltage is applied across the element, a change in dimension of the element is produced.

The element preferably includes a material that is a piezo-electric material. The advantage of such an arrangement is significant. A large number of fabrics may be used in applications wherein there is movement of the fabric or force applied to the fabric, or wherein movement of the fabric is required. Under such an effect, the piezo-electric material has positive and negative electrical charges which are separated but are symmetrically distributed so that the material such as crystal overall is electrically neutral. Each of these sides may form an electrical dipole with the effect that dipoles adjacent or near one another tend to align in regional Weiss domains. The domains are randomly orientated. When a mechanical stress is applied, the symmetry is disturbed and the charge asymmetry generates a voltage across the material.

In reverse, an electrical field applied across the material causes a shape change in the material by an amount which may be typically be approximately 4%.

The thread is beneficially disposed around an elongate member defining an elongate member, and the element is disposed at least partially in the elongate member. A benefit of such a configuration is that the element may be wound or provided helically or in other configurations enabling improved flexibility of the thread.

Beneficially, at least a portion of the elongate member is hollow and the element is beneficially at least partially located in the hollow cavity. In one embodiment the element may be at least partially embedded in a wall defining the elongate member thereby improving flexibility, and may at least partially have a surface contiguous with the inner wall of the elongate member or project into the cavity. The element may alternatively be helically wound around the elongate member.

The element beneficially comprises a piezo-electric material. Such a piezo-electric material beneficially comprises a crystal or a ceramic or maybe a combination thereof. The element may comprise silicon oxide in one embodiment.

The textile thread may further comprise a power source in electrical communication with the element. Such a power source enables an electrical field to be supplied across the element. A power source may be provided by any suitable means as described herein or through the provision of any traditional power source.

The present invention also extends to a fabric including a textile thread or fibre as hereinbefore described.

The fabric may comprise a tyre for a vehicle for example.

The fabric may further comprise a receiver for receiving a signal causing a change in operation of the power source between an 'on' configuration for supplying electricity to the element and an 'off' configuration whereby supply of electricity to the element is not enabled. This is important in some exemplary embodiments of the present invention where one or more fibres have an electrical field applied to their respective elements meaning that the shape, for example, of the fabric is changed. The receiver may be operable to receive a signal from a remote location via wired or non wired communication means.

The fabric may also include a control arrangement for controlling the output from the charge storage device. This output may be used for a variety of purposes, examples of which are described elsewhere in the present application.

It is envisaged that a textile thread or fibre according to this aspect of the present invention may be incorporated into a wide variety of fabrics including clothing, vehicle tyres, vehicle/aeroplane seats, the sails of yachts, window curtains, tents, rucksacks, bags or other containers, canvas or textile shoes (including the laces thereof), tarpaulins, wind breaks, bandages and other medical textiles, the skin of a fabric for an aeroplane, flags etc. It is also envisaged that squares of fabric or any other suitable shape for generating electricity may be positioned under or on any other surface where there is movement or pressure exerted by, for example, people, animals, vehicles, machines, products (for example parcels moving through a sorting centre), airflow, liquid flow, materials flow etc. This includes domestic dwellings, offices, factories, shops, shopping centres, pavements, airports, rivers, roads, railways etc.

It is envisaged that the fibres may be of a durable polymeric material which may be used as a surface on its own, for example at a sporting event, a music festival or a rescue site.

In one embodiment of the present invention, the thread comprises a polymeric elongate member and the element is helically wound either fixed onto a surface of the elongate member, beneficially the inner surface, or alternatively embedded into the wall defining the elongate member. Partial or complete embedding may be achieved. In such a configuration flexibility of the fibre or thread is improved. The elongate member may be then wrapped utilising standard wrapping techniques as described elsewhere in the present application and may be formed into a fabric. One or more batteries or capacitors or other forms of electrical charge storage devices may be inserted into one or more of the individual threads or fibres. Alternatively, each thread or fibre may be linked via an electrically conductive material and directed to a single charge storage device which is provided for a plurality of individual threads or fibres. The batteries, capacitors and other forms of electrical charge storage devices may receive electrical power from external sources of all types, including by induction and by radio frequency converted into electric current. This may be controlled by the invention such as disclosed in WO02/084617.

Suitable materials exhibiting piezo-electric properties may be naturally occurring (e.g. crystals or ceramics) or manmade silicon dioxide is a suitable piezo-electric material. Examples of such suitable materials may be polyvinylidene fluoride (PVDF). It is a particularly suitable material having flexible properties however it is also envisaged that other materials such as ceramics or silk for example, may be utilised.

As described above, a power source may be provided which is capable of both providing an electric field across the element or alternatively is capable of receiving and storing energy from activation of the element either through a force being applied to the element or movement of the element.

One aspect of the present invention relates to transfer from one energy medium to another for use in a thread or fibre. In particular, this aspect of the present invention relates to the transfer of light energy into electrical energy.

The process of energy transfer from light to electricity using photovoltaic cells is well established. The photovoltaic effect relates to photons of light knocking electrons into a higher state of energy to create electricity.

As described herein, there are a number of devices that may use electricity that may be incorporated, affixed to or utilised in a thread or fibre or a plurality of thread or fibres joined together to form, for example, a fabric. In one example, such a fabric may be of an item of clothing.

According to a seventh aspect of the present invention there is a textile thread or fibre defined by one or more individual fibres disposed at least partially around an element, the element including a photovoltaic material.

This aspect of the present invention provides a significant benefit in that a thread or fibre may be utilised to harness and convert energy to a useable form.

The element beneficially comprises a plurality of photovoltaic cells comprising an array. The photovoltaic element preferably comprises a plurality of interconnected photovoltaic cells.

The photovoltaic element beneficially comprises a flexible elongate filament and preferably one or more individual fibres are wrapped around the photovoltaic element.

The thread or fibre is beneficially a textile thread or fibre. Accordingly, for example, an item of clothing may be utilised to harness and convert energy to a useable form for example for the purpose of causing cooling of the person wearing the item of clothing. It is envisaged that this would be particularly beneficial in, for example, a military application whereby it would be dangerous for a user to remove that item of clothing.

The one or more individual fibres are beneficially disposed around the element and comprise a material for enabling light to pass therethrough.

The one or more fibres are beneficially disposed around the element and are wrapped with spacing between each individual thread or fibre for enabling light to pass therethrough. Accordingly, during manufacture and in particular using a core wrapping machine, spacing is enabled which allows light to pass through the one or more individual fibres disposed around the element in order that light can pass to the element. In an alternative embodiment, it is envisaged that the element may be provided which extends substantially radially relative to the thread or fibre, and may be termed a protrusion or nodule.

One aspect of the present invention relates to a provision of a textile thread or fabric which beneficially has anti-microbial qualities.

It is currently known to integrate silver into a variety of products in order to give these products anti-microbial qualities. For example, silver impregnated footwear is available to help prevent foot odour which is chiefly caused via bacteria, and silver impregnated socks cut down on the cases of athlete's foot. Additionally, toothbrushes are available containing tiny particles of silver embedded into the bristles which helps cut down on bacterial contamination. Fabrics such as kitchen cloths or bed clothes containing impregnated silver particles into the fabric helps keep them fresh and bacteria free for much longer after washing. It is even known to add silver impregnated coatings to door knobs, sinks and toilet seats as examples only in a bid to help homeowners keep the spread of bacteria at bay.

The silver particles act to kill some of the bacteria thereby reducing health risks. However, there are limitations associated with impregnated silver particles. Silver particles only work in the presence of certain levels of moisture and are gradually removed by the processes of washing, laundering and dry cleaning. After the particles have been removed by these processes, it is not practical to insert new silver particles into the textile items. Furthermore, silver particles kill only a limited range of bacteria and are even less effective against viruses. They have little or no effect on fungi or yeast.

Additionally, silver particles may find their way into water courses and it is generally believed that silver particles kill fish and other aquatic live stock via normal water drainage systems, the particles find their way into farm land which has an adverse effect on soil microbes which are essential to crop production.

An eighth aspect of the present invention aims to overcome these problems.

According to an eighth aspect of the present invention there is a textile thread or fibre comprising an energy emitting source encapsulated or embedded therein, wherein the energy emitted is substantially in the ultraviolet energy band.

The provision of an ultraviolet light source encapsulated in the textile thread or fabric has a number of significant advantages over the use of embedded silver particles. The embedding of an ultraviolet emitting source is less costly than using silver particles and will work in the absence of the presence of moisture. An ultraviolet emitting source will not be removed by any cleaning process and will kill all bacteria, viruses, fungi and yeast and will not affect fish or other aquatic life nor will it affect farming processes. Such an arrangement is particularly important in, for example, medical use such as within intensive care wards, bandages and other wounds treatments where the control of bacteria and viruses is essential. Such an arrangement would also aid in the control of MRSA hospital infections, and similar organisms.

There may be a number of beneficial effects associated with the emitting of ultraviolet radiation. Ultraviolet radiation induces the production of vitamin D in the skin which has a positive health effect relating to the nervous system as well as for bone growth and maintenance of bone density. Furthermore, blood pressure is believed to be related to vitamin D in the skin. However, too much ultraviolet radiation may lead to damage to the skin and may be controlled by the invention as described in WO02/084617. As such, fibres may be produced into an item of clothing for example and the item of clothing may be used as a medical aid. Various wrapping techniques may be used to embed or encapsulate the filament where the individual fibres that wrap around the filament (whether the filament is located in a casing or in the core of a supporting member for example) are envisaged depending on the requirements for the textile thread or fibre. In one embodiment, the wrapping of the threads or fibres around the filament may be more widely spaced than would be envisaged in normal core wrapping techniques in order to enable the ultraviolet radiation to successfully pass through the textile material which may, for example, be cotton or wool or polyester. Alternatively, ducts defining an outlet may be configured to extend through the wrapping of the filament thereby enabling energy to pass through the duct and out of the textile thread or fibre. In a further alternative embodiment, the textile material surrounding the filament may include portions of alternative materials which are less absorptive of ultraviolet radiation than the general material that makes up the textile thread or fibre which again may be, for example, cotton.

The ultraviolet emitting source beneficially comprises a flexible filament and beneficially the filament is retained by a carrier arrangement.

The carrier arrangement may be a support member, wherein the filament is embedded in a wall of the support member, and wherein the support member defines an internal cavity. In an alternative embodiment, the filament may be directly wrapped in the individual threads or fibres of a textile thread. For added strength and longevity, a casing may be provided to house the filament.

Control apparatus and a power source are beneficially provided for controlling the ultraviolet radiation emitted.

A sensing means is beneficially provided for sensing the strength of the ultraviolet light emitted from the textile thread or fibre, and the control apparatus is beneficially arranged to control the intensity of the ultraviolet radiation emitted from the emitting source. The sensing means may also be arranged to sense ultraviolet radiation received by the thread or fibre (or fabric into which the thread or fibre is incorporated).

A ninth aspect of the present invention relates to an arrangement which may indicate where an object or for example a person wearing an object such as an item of clothing may be found.

In the aftermath of a natural or manmade disaster, rescuers often have difficulty in finding the victims either at all in sufficient time to save lives.

One aspect of the present invention provides a solution to such a problem.

According to a ninth aspect of the present invention there is a textile thread or fibre including an element arranged to emit energy in substantially the infrared range, wherein the element is substantially embedded or encapsulated in the textile thread.

Infrared emission can be recognised by appropriate equipment at great distances and reflects from many surfaces. Low intensity infrared emission can be detected in complete darkness and through media which may confuse or completely fail other methods of detection, for example fire, smoke, dust clouds and cloud or other water vapour. Furthermore, a number of mechanical devices have been developed which are used to locate disaster or accident victims and are generally small scale wheeled or tracked devices which use both optical and infrared methods of locating victims. The arrangement according to this aspect of the present invention makes the operation of the search devices significantly more effective, and assists in human/animal searches.

The element beneficially emits energy in the range substantially 700 nm to 300 μm.

The element may comprise a flexible element that may be elongate. In one embodiment, a plurality of elements may be substantially embedded or encapsulated in the textile thread or fibre.

The textile thread or fibre beneficially comprises at least a portion of an elongate member, wherein the element is at least partially located in the elongate member. In one embodiment, the element is beneficially at least partially embedded into a wall of the elongate member. The elongate member may be generally hollow. The element may be at least partially fixed to an inner surface of the wall of the elongate member.

The textile thread or fibre is beneficially made up of one or more individual threads or fibres wound around the element. The one or more individual textile threads or fibres are beneficially wound helically around the element. A spacing means may be provided between the one or more individual textile threads or fibres wound around the element. Spacing enables improved emission of radiation through the textile thread or fibre thereby increasing the potential of the radiation being received by a receiver. The wrapping of the one or more individual threads or fibres around the element may be spaced apart during manufacture, however spacing means such as spacing elements are beneficial to ensure accuracy of spacing to allow emission of energy, and such spacing elements would also ensure that the wrapping does not move over time to affect energy emission. A sufficient number of spacing elements (or nodules as described elsewhere in the specification) should be incorporated to ensure the required energy emission.

The spacing means is arranged to project at least partially through the one or more individual fibres wound around the element and is configured to enable emission of infrared radiation therethrough. The spacing means may comprise one or more nodules. These nodules may project generally perpendicular to the element, and include a material transparent to ultraviolet radiation or may comprise an opening.

An anti static agent may be incorporated into any of the aspects of the invention as hereinbefore described. The anti static agent is beneficially introduced into the elongate member however may be introduced into, for example, the one or more fibres that wrap around the core. Such an anti static agent may treat the textile thread or fibre in order to reduce or eliminate build up of static electricity. This build up of static electricity is generally caused by the driboelectric effect. The antistatic agent makes the surface of the textile thread or fibre slightly conductive by either being conductive itself or by absorbing moisture from the air. It will be appreciated that internal anti static agents may be used which can be incorporated directly into the elongate member for example or alternatively into the one or more fibres surrounding the core (e.g. the elongate member) or may be an external anti static agent which may be applied to the surface. This surface may be the outer surface of the textile thread or fibre or may alternatively be the outside surface of the core which may be the elongate member.

Examples of anti static agents may be, long chain aliphatic amines for example.

Aspects of the present invention will now be described by way of example only with reference to the accompanying drawings.

Figure 1:
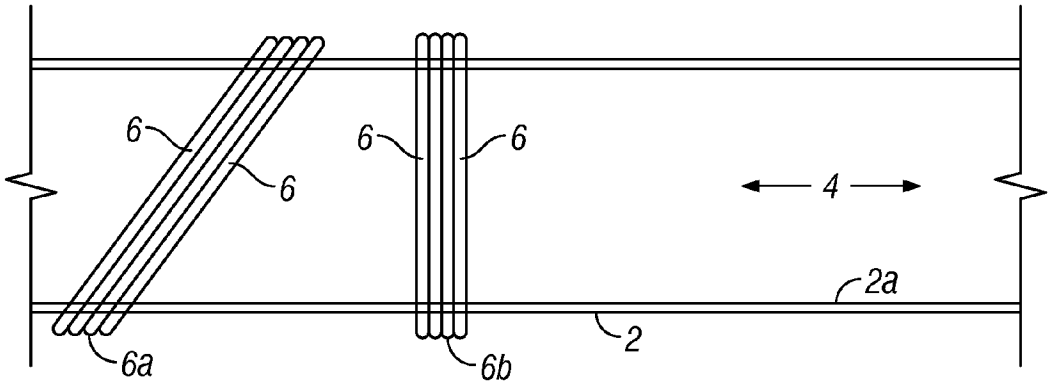
FIG. 1 is a schematic side view of a textile thread or fibre according to an exemplary embodiment of aspects of the present invention.

Referring to FIG. 1, there is a schematic cut away side view of a thread according to an exemplary embodiment of the present invention. FIG. 1 specifically shows an elongate member 2 defining a hollow core which defines a flow path 4 therethrough having one or more individual fibres 6 disposed around the elongate member 2. The fibres 6 shown in FIGS. 1 and 2 have been wrapped or wound helically as represented by numeral 6*a* and fibres are wound generally perpendicular to the longitudinal length of the elongate member as represented in 6*b*. The flow path 4 is defined by the inner wall 2*a* of the elongate member 2 and as shown in FIG. 1 enables a fluid such as a gas or liquid (for example) to flow therethrough. Heat energy may be transferred through conduction from outside of the elongate member to the gas or liquid (preferably air in one embodiment) flowing in the core of the elongate member thereby providing a cooling effect. The core of the elongate member could potentially be filled with another material such as a liquid.

The elongate member is beneficially constructed of a flexible material that may flex and adapt to different shapes such that the thread can be incorporated into a fabric. For this purpose, a cylindrical elongate member is beneficially provided as such a shape provides the optimal opposing forces to compression. A polymeric material is beneficially utilised and an example of such a suitable material is polyvinyl chloride (PVC). It will be appreciated that in the example as shown in FIG. 1, the core of the elongate member is indicated for schematic purposes as having a relatively large diameter. However it will be appreciated that in order for the thread or fibre to be present in, for example, a traditional item of clothing for example, the diameter of the thread or fibre including the elongate member will not be significantly greater than that of a traditional textile thread or fibre utilised for example in clothing.

It will also be appreciated that in FIG. 1, no apertures are provided in the wall of the elongate member. Such apertures are described with respect to the exemplary embodiment as indicated in FIG. 2, however, it will be appreciated by a person skilled in the art that the embodiment as indicated in FIG. 1 beneficially comprises one or more apertures through the wall of the elongate member thereby defining a fluid flow path from the core to outside of the elongate member.

Figure 2:
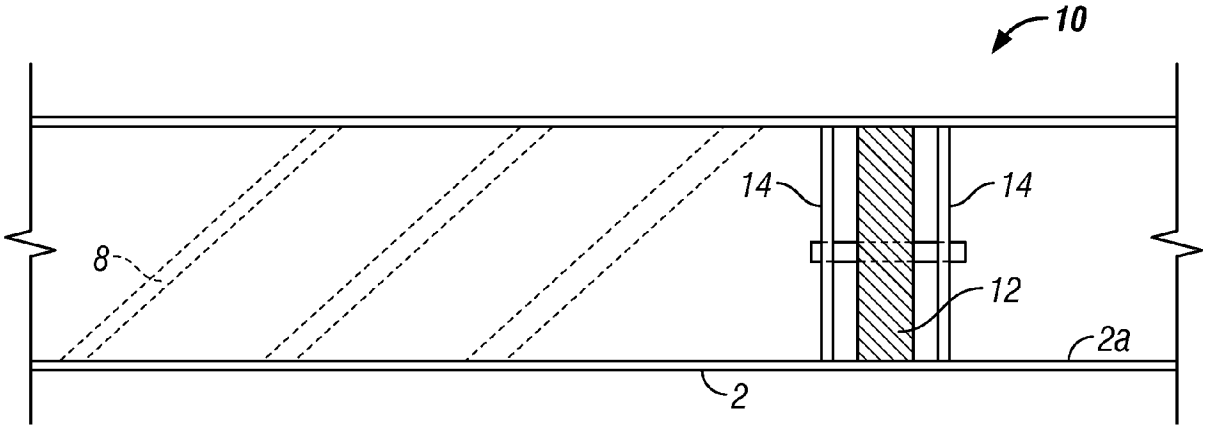
FIG. 2 is a schematic side view of a textile thread or fibre according to an exemplary embodiment of one or more aspects of the present invention.

Referring to FIG. 2, there is provided an elongate member 2. The fibres surrounding and wrapped around the elongate member have not been represented in FIG. 2 for clarity purposes. It will be appreciated, however, that such fibres are wrapped around the elongate member in their desired configuration, which for ease of manufacturing is beneficially helical.

Referring to FIG. 2, an aperture 8 is provided in the wall of the elongate member. In the embodiment as indicated in FIG. 2, the aperture is a continuous helical aperture winding about the elongate member 2. Such a helical aperture may be beneficial as significant strength of the elongate member is maintained however there is significant access to enable fluid, beneficially gas, to escape from the core of the elongate member. A number of alternative configurations of the aperture can be envisaged which may extend generally longitudinally along the length of the elongate member or alternatively in the transverse direction. Combinations of such apertures may be provided. In the embodiment shown in FIG. 2, the spacing of the helical aperture may be altered depending on specific strength versus heat release properties. Furthermore, apertures may be provided throughout the entire length of the elongate member or alternatively may be provided at points along the length of the elongate member. Such apertures may effectively be ports, and beneficially may comprise nodules extending generally perpendicular to the longitudinal length of the textile thread or fibre. The nodule(s) may project through a portion of the fibres wrapping the elongate member. The nodules may be spaced along the elongate member.

A fan 10 or impeller may be provided located in the core of the elongate member. The fan 10 may comprise a plurality of blades 12 and one or more support struts 14. A fan on such a scale will fit into the core of the elongate member which enables flow of air through the core. This improves efficiency of cooling of the material and thus, for example with reference to an item of clothing, increases the comfort of the wearer through improved cooling.

In a further alternative embodiment of the present invention, the elongate member can be made sealed and leak proof and contain a liquid coolant or refrigerant. This may apply to a sector of the cross section of the hollow core profile, or the entire diameter and may extend through the desired longitudinal length of the fibre. This liquid may function as a simple coolant which transfers heat from one place in the textile fibre to another place or alternatively may transfer heat to a heat sink or potentially to a heat store. The liquid may be a refrigerant gas instead and the system may function as a refrigerating system using a standard refrigeration configuration on a small scale. The sector or the channel for transferring the coolant may be arranged in a helical or spiral manner thus improving the cooling effect in any one textile thread. If a cooling liquid is used, pumps should be incorporated into the hollow core of the elongate member in order to move the coolant liquid through the hollow core. It will be appreciated that in return the heat store or heat sink can be utilised as a heating system, meaning that stored heat energy can be released as necessary in order that the thread and beneficially the fabric is heated. Control of such a system may be provided using a control arrangement, the circuiting and components described for example with reference to WO02/084617.

Wicking type fabrics are common and relatively modern technical fabrics which draw moisture away from the body. An example of the material used may be polyester which absorbs very little water. For example, cotton will absorb 7% of its weight in water, whereas polyester will only absorb 0.4%. Cotton will therefore retain sweat in a garment however the cross section and large surface area of polyester ensures that moisture is picked up from a body of a user wearing such a garment and causes the moisture to spread out and evaporate easily on the outside of the fabric.

Capillary pressure causes movement of moisture along or through a fabric. In an exemplary embodiment of an aspect of the present invention a fibre made out of polyester may be provided around which is wound the material of the garment. Moisture moves from the wearer of the garment into the material such as cotton which encapsulates the polyester fibre and then moves into the polyester fibre. Due to the structure of polyester, the capillary pressure is high meaning that the force of the surface tension between the liquid and the walls of a narrow gap or pore in the polyester overcome the forces between the molecules of the liquid therefore moving it into empty gaps until the forces even out. This is known as capillary pressure. Accordingly, moisture transfers along the fibre.

The wrapping of the fibre around the wicking fibre material such as the polyester may be wrapped in such a way to allow the cooling effect to function. A wrapping may be performed in a variety of wraps as described elsewhere in the specification such as, for example, helically. In one embodiment a looser wrapping around the wicking fibre is enabled so as to allow the egress of moisture. This also enables improved transfer of moisture from the wearer to the encapsulated fibre.

In an alternative embodiment, an elongate member beneficially made of a polymeric material as described elsewhere in the present application may be utilised around which is wrapped fibres or thread which are then woven together to form a garment. It will, however, again be appreciated that a wide variety of fabrics may be provided. In such an embodiment nodules extending from the elongate member as previously described may be provided which allow egress or moisture from the elongate member. The nodules thereby effectively provide an exit port.

Figure 3:
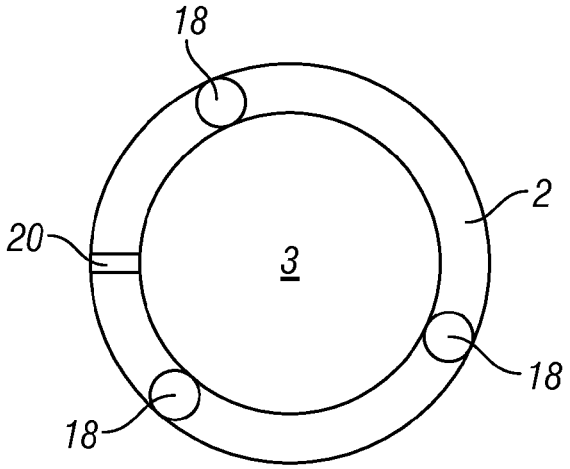
FIG. 3 is a schematic cross sectional view of a textile thread or fibre according to an exemplary embodiment of an aspect of the present invention.

In one embodiment as represented in FIG. 3 in cross section, the elongate member may have a wicking fibre 18 embedded therein and the wicking fibre may extend through the wall of the elongate member such that the wicking fibre faces both inwards and outwards, i.e. it would allow moisture to pass through the wall of the elongate member 2 defining a hollow core 3. The textile fibre or thread is wrapped (helically for example) around the elongate member and the wrapping can be varied so as to allow variation in the spacing of the wrapping to allow for the egress of moisture laden air of for the ingress of fresh air (or nodules may be utilised).

There may be provided one or more openings or apertures or nodules 20 in the wall of the elongate member 2 which will enable cool air to enter the core 3 as well as moisture laden air to exit. The nodule 20 may extend beyond the circumferential edge of the elongate member and extend through at least a portion of the depth of the fibres wrapped around the elongate member. It will be appreciated that movement of the fabric into which the textile threads or fibres are woven improves the flow of air thereby improving the wicking capabilities.

The provision of nano fans or fans on a sufficiently small scale has been described elsewhere in the present application to cause movement of air through the core 3. It will be appreciated that this will assist in the egress and ingress of air.

It will additionally be understood that heat sinks be located at points in the textile thread or fibre made up into the fabric.

It will be appreciated that power and control circuitry is provided to activate the nano fan, control the rate of flow of air through the core and to control the cooling effect to cool specific areas or sections of the fabric item into which the thread or fibre is incorporated.

A liquid has been described above as being present in the core of the elongate member of the textile thread or fibre. In one embodiment a fluid which may comprise a liquid or gas is provided which may, for example, be a medicine or a material which is suitable for repelling insects, for example mosquitoes. Such fluid may be provided in either the core or in a compartment or reservoir or in a series of individual compartments or reservoirs. A control arrangement is provided which enables release of a predetermined volume of fluid from the reservoir via a valve arrangement through a port or nodule as previously described and into the individual textile threads or fibres that surround the reservoir or core. Alternatively, spacing may be provided in the wrapping of the individual textile threads or fibres that surround the core, which may be provided by one or more nodules. A nodule or duct may be provided which extends from the core or reservoir through the individual textile threads or fibres that are wrapped around the core or reservoir in order that a port is provided at or adjacent the outer diameter of the overall thread or fibre. A valve arrangement may be provided in the nodule or duct along the longitudinal length of the duct which enables release of the fluid from the reservoir or core. A control arrangement is provided which may comprise a user operable interface which enables release of the fluid. A user may then activate the valve in the event that medication or an anti-insect fluid should be released. Alternatively, the control arrangement may be set in order that a predetermined volume of fluid is released at predetermined intervals.

The valve is beneficially a two way valve which enables the reservoir or core to be refilled with suitable fluid. Alternatively, replaceable cartridges or reservoirs may be provided which may be configured to be plug in cartridges which when inserted enable the fluid to pass through a port which becomes effective once the cartridge is inserted. Such a cartridge system may be similar to a fountain pen type arrangement.

One or more pumps hereinbefore described may be provided which are activated by the control arrangement in order that pressure is increased in the core or the reservoirs in order to increase the pressure to effect release of the fluid in the core or the reservoir. This will cause release of the fluid from the core or the reservoir. The control arrangement may be controlled by circuitry and components as described with respect to WO02/084617. Accordingly, a power supply may be provided with a selective power 'on' and 'off'. The flow direction of the fluid may be changed through changing of the direction of the pump which furthermore may be increased or decreased in speed in order that the rate of administrating of the fluid is increased or decreased. Furthermore, a whole garment or item made up of a number of textile threads or fibres having fluid therein may be provided, and the control arrangement may cause release of the fluid from an individual area or section of the item. Additionally, a monitoring arrangement may be provided to report on the reservoir level, the rate of application etc.

It is envisaged that the present application may be used for the administering of medications and as such suitable devices may be mounted in the textile thread or fibre in order to communicate with the wearer's skin or even alternatively configured to project into a user's skin.

Textile threads or fibres which would be particularly suitable for inclusion of an insect propellant would be bed sheets, mosquito nets, bandages and other wound dressings, canvas or other textiles used to make tents, fly stop screens such as those fitted to doors and windows, curtains, cloth used for car seats, car interior linings and other transportation forms and artificial ski slopes which are listed as examples only.

In one embodiment of the present invention, a power generation device is provided which comprises a turbine and is partially positioned in the core of the elongate member of the textile thread or fibre. The turbine is mounted preferably within the core and air passing through the core causes activation of the blades of the turbine and charge is stored in a charged storage device which has a capacitor or battery. A transfer means such as an electrically conductive wire or cable connects the turbine to the charge storage device, and it is envisaged that two or more wires or cables may be provided. It is further envisaged that a control arrangement may be provided in order to control activation of the turbine and charge storage device. Therefore, the device may operate in one embodiment wherein air is passing through the core activating the turbine blades thereby producing electricity. This electricity is beneficially stored in a charge storage device. Alternatively, operation of the arrangement may be reversed in order that power is provided to the turbine which causes rotation of the blades only. This has the effect of causing air movement within the core in the event that airflow is required for transferring cool or warm air through the core.

Control electronic circuitry is beneficially provided in order to enable the power to be turned on and off; the pump to change direction of the coolant flow, or to increase the rate of flow. Furthermore, control may be provided to limit the cooling effect to specific areas or sections of the item such as a piece of clothing or alternative to ensure that the whole garment is cool. Such control may be enabled through an electronic system as described in WO02/084617.

One embodiment of the present invention relates to heating of a textile thread. Also in the specification as filed there are a number of ways in which useable electrical energy may be generated and stored. The present invention enables such stored energy to be released when required for heating purposes. Alternatively, a power source may be provided which is beneficially located encapsulated within the textile thread and may be, for example, a battery.

Figure 4:
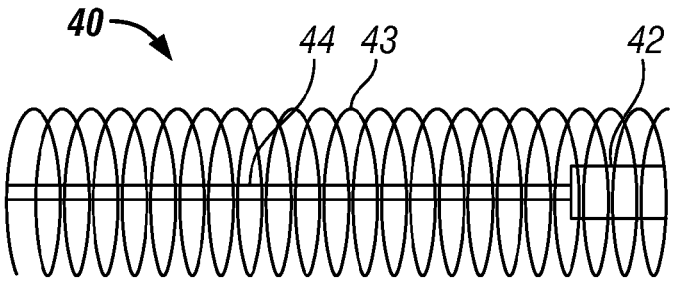
FIGS. 4 and 5 are schematic side views of an exemplary embodiment of an aspect of the present invention.

Referring to FIG. 4, there is a schematic representation of an exemplary embodiment of one aspect of the present invention. There is generally shown a textile thread 40 showing a power source 42 and a resistive heating element 44 which is arranged to extend through the textile thread 40. The resistive element may include an outward flowpath from the power source 42 and a return flowpath back to the power source 42. Alternatively, the circuit may be completed via the heating element extending to an adjacent textile thread and extending through an adjacent textile thread and returning back to the power source 42.

Figure 5:
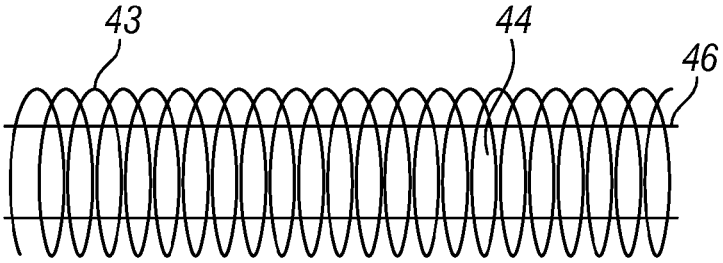

Referring to FIG. 5, in an alternative embodiment the heating element 44 is provided wrapped around an elongate member 46 defining the core and the heating element may be provided secured to the elongate member, which is beneficially hollow. The heating element may be secured to, embedded or encapsulated in a wall of the elongate member. In one embodiment, the heating element may be at least partially embedded in a wall of the core. The core of the elongate member may be hollow and passing current through the heating element may cause the fluid such as liquid or gas (preferably air) within the core to be heated which may be transferred through the hollow core. A fan arrangement may be provided to cause transfer of the heated fluid through the hollow core (which may be air).

The heating element is beneficially a metallic or ceramic material and may include nickel. The heating element may include barium titanate or lead titanate. One or more fibres may be wrapped around the elongate member in a helical configuration wherein the fibres are generally designated by the reference numeral 43.

Figure 6:
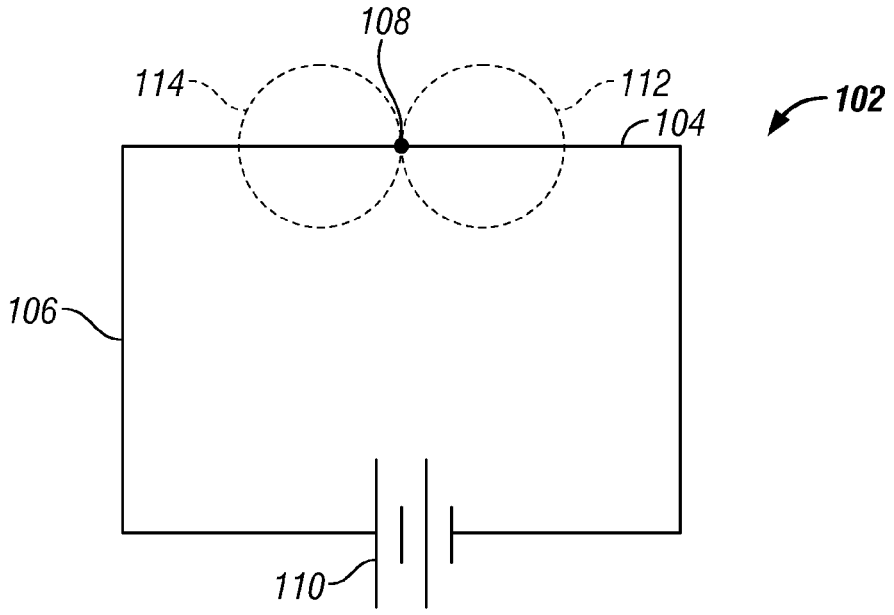
FIG. 6 is a schematic circuit diagram showing how cooling or heating can be achieved of zones in a circuit.

Referring to FIG. 6 there is a basic representation of a circuit 102 capable of exhibiting the Peltier or Seebeck effect, wherein a power source 110 is provided in communication with a first conducting material 104. A junction 108 is provided between the first conducting material and a second conducting material. Depending on the properties of the materials, when a current is supplied through the circuit one side of the junction 108 heats up at zone 112 and the opposing side of the junction 108 at zone 114 cools down.

Figure 7:
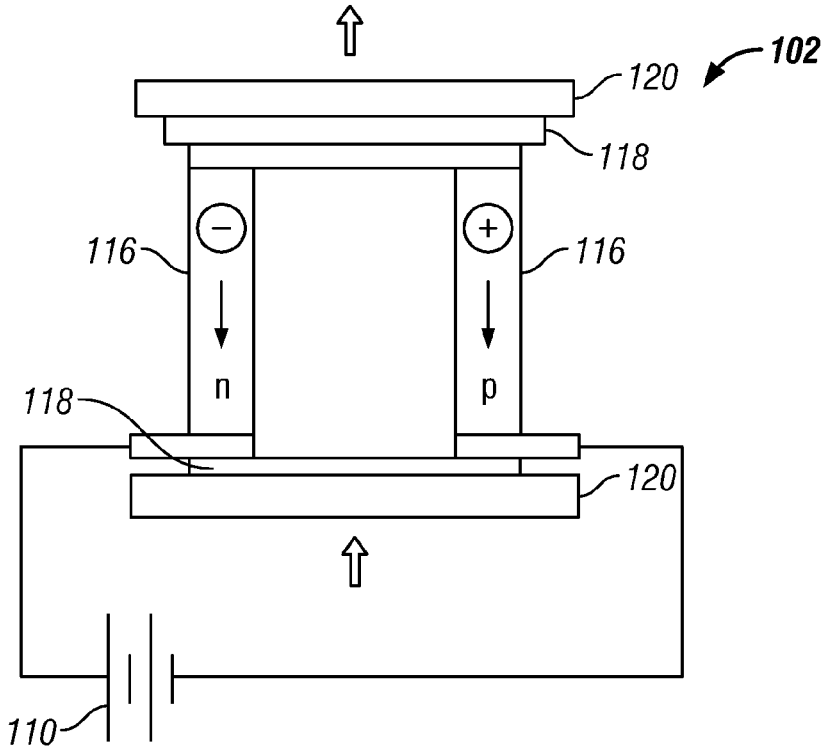
FIG. 7 is a schematic circuit diagram of a single cooling or heating module that may be incorporated into a textile thread according to an exemplary embodiment of one aspect of the present invention.

Referring to FIG. 7, a solid state cooling system 102 (single module thereof) is represented schematically showing a DC power source 110. A typical solid state cooling system includes a semi-conductor based component 116 of bismuth telluride doped to obtain N-P junctions. The component 116 is secured, possibly by soldering between ceramic plates 118 and covered with an insulation 120. This insulator forms the useable heat sinks. When current is passed through the junction of the two different conducting components 116 a temperature change is achieved. Clearly, if current is passed in the opposing direction the opposite heating/cooling effects will be achieved at the heat sinks.

Figure 8:
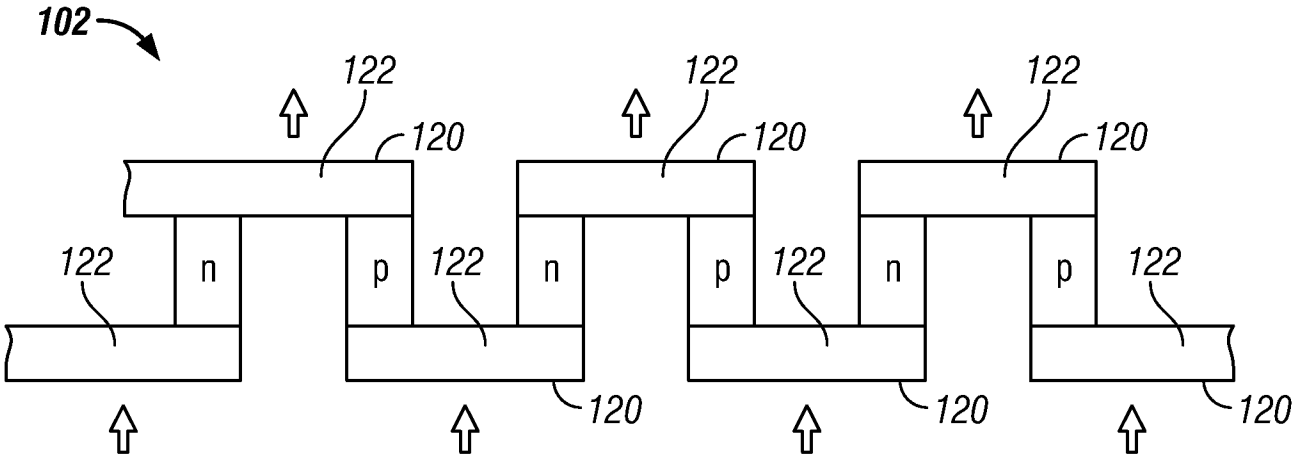
FIG. 8 is a schematic representation of a first side of a partial circuit of modules that may be incorporated into a textile thread according to an exemplary embodiment of an aspect of the present invention.

FIG. 8 is a schematic representation of a plurality of components similar in configuration to those described with respect to FIG. 7. Such plurality of components form a chain or fibre that can be positioned or embedded in a textile thread wherein the opposing or alternating heat sinks 120 form a portion of an outer surface of the textile thread. The adjacent heat sink 120 extends through the wall of a hollow elongate member around which textile threads or fibres are wrapped and thus alternating heat sinks are in communication with the hollow core of the elongate member and the environment surrounding the textile thread or fibre. In this way, heat can be absorbed from outside the thread and passed and released into the hollow core of the elongate member. The elongate member may be wrapped with one or more fibres, and it is beneficial if the fibres wrapped around the elongate member are wrapped to enable the heat sink to contact the surrounding atmosphere thereby acting as a nodule described elsewhere. As shown in FIG. 8, the n and p doped elements are connected by a conductor with spacing between adjacent components or modules. It will be appreciated however that a conductor may extend across the tops and/or bottoms of the series of components or modules.

Current to the circuit may be supplied by a power source such as a cell or battery, or by one or more of the power generation devices described elsewhere in this document.

Figure 9:
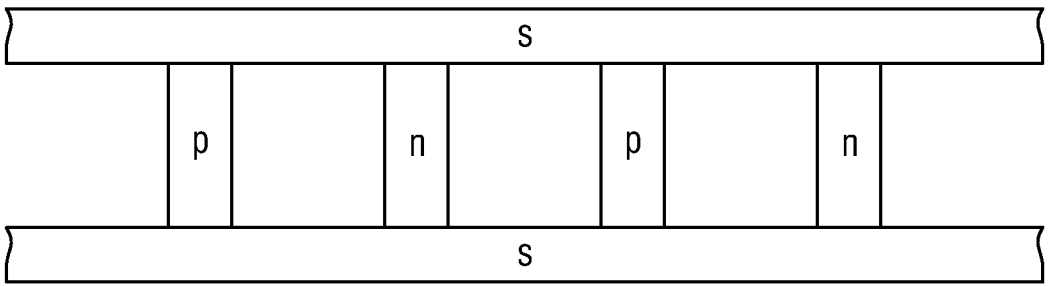
FIG. 9 is a schematic representation of a second side of a partial circuit of modules that may be incorporated into a textile thread according to an exemplary embodiment of an aspect of the present invention.

Referring to FIG. 9, the opposing side of the series of modules of FIG. 8 is shown, showing a control system indicated by 'S', which enables control of the current to one or more of the circuit. If selection of current to one or more modules is required, a current flow path must be selected accordingly.

Figure 10:
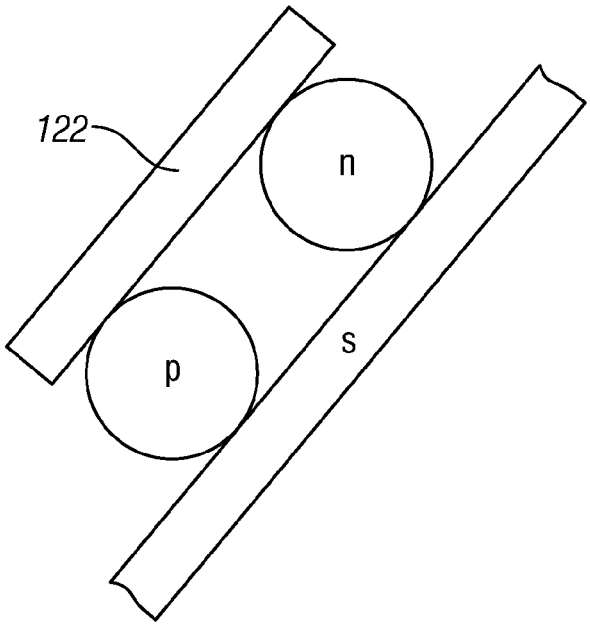
FIG. 10 is a schematic extrados view of a module within a hollow core of a thread according to an exemplary embodiment of one aspect of the present invention.
Figure 11:
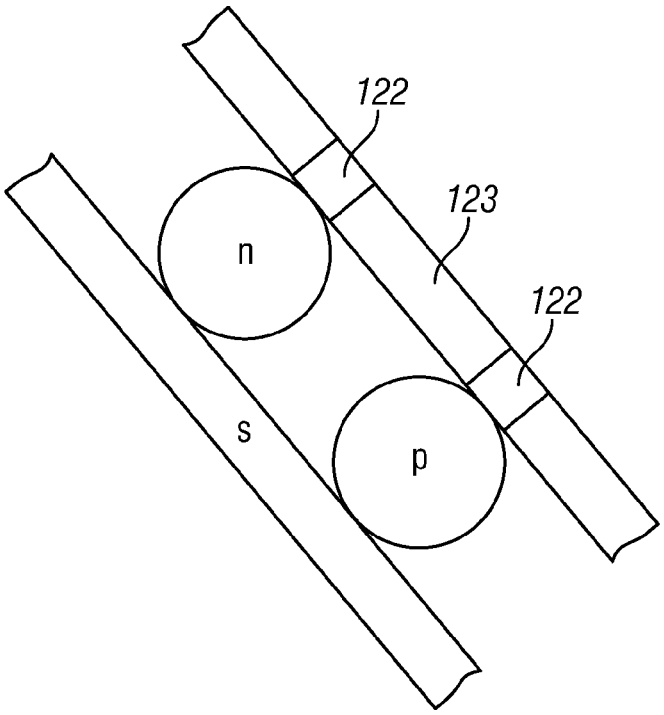
FIG. 11 is a schematic intrados view of a module within a hollow core of a thread according to an exemplary embodiment of one aspect of the present invention.

Referring to FIGS. 10 and 11, the modules of FIG. 9 are shown when embedded in a wall of the elongate member. The core of the elongate member beneficially comprises a hollow cavity with a plurality of modules embedded therein. FIG. 10 is an extrados view of the cavity, and FIG. 11 an intrados view. The series of modules beneficially extends helically around the elongate member which provides the greatest surface area and also gives the greatest strength to the elongate member. Reference numeral 123 is a representation of an insulator or air.

Figure 12:
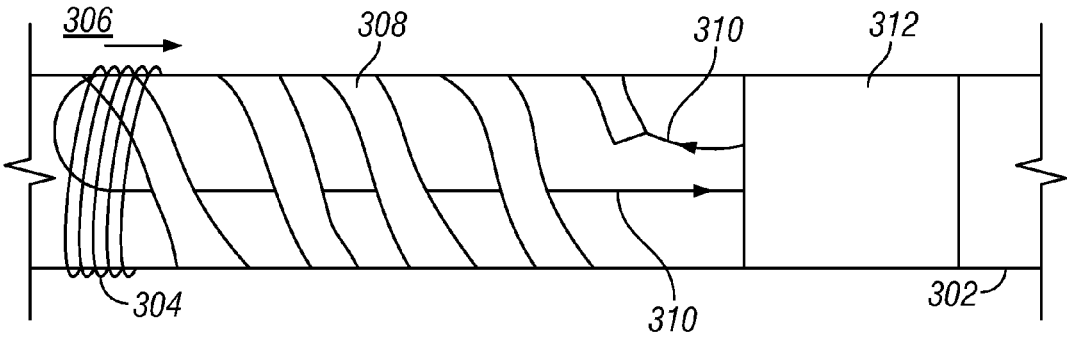
FIG. 12 is a schematic representation of an exemplary embodiment of an aspect of the present invention.

Referring to FIG. 12, there is a schematically exemplary embodiment of the present invention wherein an exemplary power source is provided which is capable of receiving and storing energy and also supplying electrical energy to the element. FIG. 12 represents a textile thread which comprises an elongate member 302 around which is wrapped one or more individual fibres 304. For clarity, the fibres 304 have not been shown around most of the elongate member 302 however arrow 306 is indicative that the wrapping of one or more individual fibres is around generally the entire length of the elongate member 302. In this exemplary embodiment an elongate member 302 defining a hollow core is provided, however, in a simplest embodiment the one or more individual fibres may be wrapped around the element and potentially the power source directly.

The elongate member 302 beneficially comprises a polymeric material having flexibility enabling the textile thread to have properties similar to a normal or standard, for example cotton, thread. The element 308 is represented as helically embedded, affixed or otherwise secured inside the elongate member 302 and electrical connection means 310 are provided to extend between the element 308 and the power source and/or storage device 312. It will be appreciated that the element may extend longitudinally along the length of the textile thread and there may be one or more elements provided. Means may be provided to control the voltage applied to the element 308 in order to facilitate control of the change of shape achieved.

It will be appreciated that there are numerous uses for such a device such as expelling or drawing in of a liquid or other mobile material from a container which may be the administration of a drug or other medicine. In such an embodiment there may be advantages in the provision of a receiver for receiving a signal causing the power source to change the mode of operation from either off to on or on to off, or to control the rate of expelling or drawing in of the liquid or other mobile material.

The present invention may be used for remote or automatic wrapping, for example wrapping a suspect package in an anti-ballistic material such as Kevlar. The remote wrapping of any shape of object may be achieved if the shape of the object is irregular.

Remote or automatic opening and closing of textile containers or textile lining fitted with the containers made of other materials may be achieved. This may, for example, include automatic self sealing of containers which are used to hold dangerous, inflammable, volatile or environmentally sensitive materials. This could include fuel tanks, chemical containers, explosive containers, containers which must be kept sealed to prevent ingress of light, air, damp etc.

The opening and closing of curtains or blinds may be achieved, for example, in particular for use in horticulture or some industrial processing. Adjusting the curvature of window blinds to allow a greater or lesser ingress of light or privacy may be achieved.

The shape of a seat, for example a car seat may be achieved to fit a particular driver whereas other applications include hospital beds or seating for the elderly or infirm.

The angle of an aeroplane wing may be adjusted and similarly the curvature of a sail.

Shape retention or the return to a required shape or change to a required shape may be achieved through, for example, crease removal. Furthermore, clothing made of a fabric incorporating one or more textile threads or fibres according to the present invention may be achieved for example a jacket and for adjusting the degree of the jacket being open or closed in response to temperature or light or other climatic conditions. Furthermore, this function may also be used in bandages in order to, for example, control the compression.

An exemplary embodiment of the seventh aspect of the present invention will now be described with reference to FIG. 13.

Figure 13:
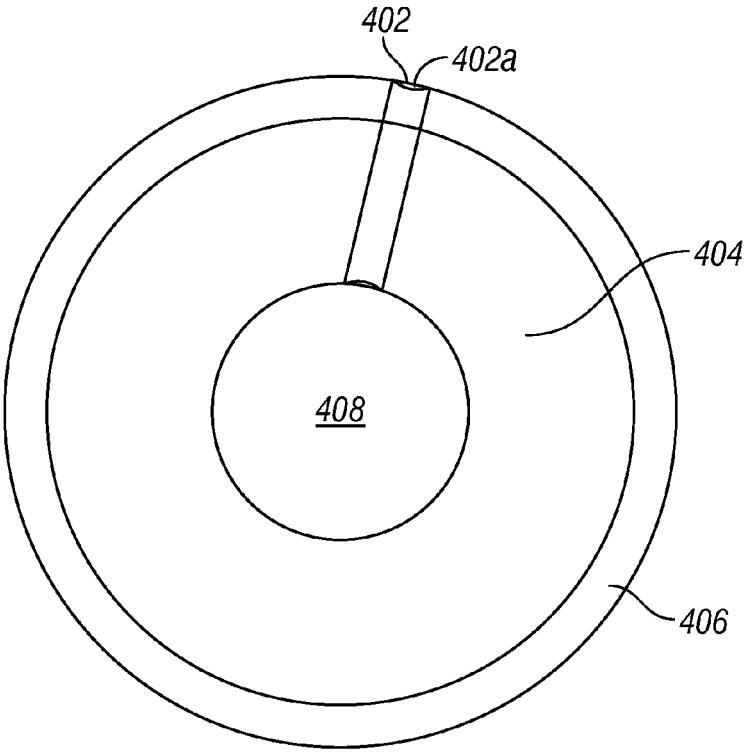
FIG. 13 is a schematic cross sectional representation of an exemplary embodiment of a seventh aspect of the present invention.

Referring to FIG. 13, there is an exemplary embodiment of the seventh aspect of the present invention which has been shown wherein the photovoltaic element 402 is supported by an elongate member 404 which is preferably elongate and generally hollow, thereby defining a core. The elongate member 404 may be made of a flexible polymeric material. The elongate member 404 is surrounded and encapsulated by one or more individual threads or fibres 406. The element 402 comprises a protrusion or nodule which extends from being supported in the elongate member 404 through the individual threads or fibres 6 when they are wrapped around the elongate member 404. As such, the tip 402*a* of the nodule extends to approximately the same height as the thickness of the individual threads or fibres, and may protrude from the thread or fibres 406. Even more beneficially, the tip 402*a* is slightly withdrawn from the thickness of the individual fibres surrounding the thread or fibre meaning that some protection is afforded to the element 402. It will be appreciated that it is not essential for the provision of an elongate member 404, however, such an inclusion allows for support to the thread or fibre and the element 402 whilst also providing a core defining a channel 408 in which may be located connecting means such as a wire for connecting the element 402 to an electrical charge storage device. The storage device, for example a battery, may also be encapsulated in the textile thread or fibre via the one or more individual fibres.

An electric charge storage device is beneficially provided in communication with the photovoltaic cell. The charge storage device may, for example, be a battery or a capacitor, and is preferably encapsulated by the one or more individual textile threads or fibres.

Control of the electric charge storage device may be provided by a control means as described elsewhere in the specification.

The eighth aspect of the present invention will now be described by way of example only.

Ultraviolet light can be produced by a variety of different sources which emits electromagnetic radiation with a wavelength in the range approximately 10 nm to 400 nm The UV light emitting filament may comprise one of a number of alternative arrangements such as a black light, an ultraviolet fluorescent lamp, an ultraviolet LED which are examples only. In order that the ultraviolet electromagnetic energy is emitted from the filament, a power source is needed which may be provided by an arrangement as described in the present application. Alternatively, a replaceable or rechargeable energy source may be provided such as a battery, which is in communication with the emitter, and may be encapsulated in the textile thread or fibre. In order that the filament is shielded from possible damage through impact or outside elements, the filament is beneficially retained by a carrier means which may act as a means to protect the filaments, and beneficially the power source. The carrier means may comprise a polymeric casing for example. Means may be provided to detect and measure the ultraviolet radiation being emitted and an example of such a means is a silicon detector. The filament may be embedded or affixed in an elongate member which acts as a support member or protector in the textile thread wherein the support member extends through at least a portion of the textile thread or fabric. The support member is beneficially hollow however this is not essential and furthermore the core of the support member is beneficially made of a flexible material such as a polymeric material.

The filament may be embedded or affixed to the support member which therefore acts as the carrier means in order to achieve optimal effectiveness of the filament. The element may be arranged in a helical or double helical layout with respect to the support member.

In one embodiment elements are provided such as nodules which are arranged to provide a conduit through which the emitted radiation may pass. These nodules extend generally perpendicular to the longitudinal length of the textile thread or fibre, and as described with respect to other aspects, may extend such that the individual threads or fibres extend radially outward to substantially the same depth, height or thickness as the nodule, or the nodule may project beyond the depth, height or thickness of the threads or fibres.

Figure 14:
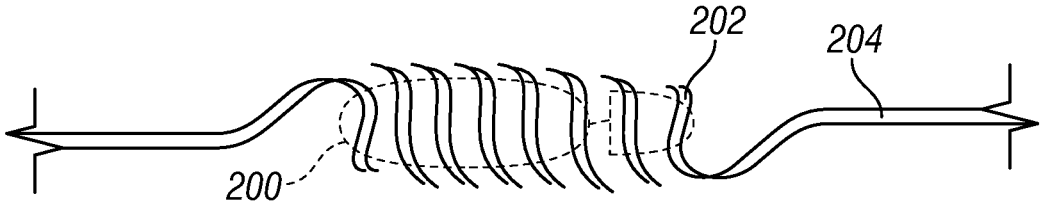
FIG. 14 is a schematic representation of a first exemplary embodiment of the ninth aspect of the present invention.

Referring to FIG. 14, a radiation emitting element 200 is provided in communication with a power source 202. The power source may be of a number of alternative arrangements as described in the present application. Furthermore, the power source may comprise a battery which may be replaceable or rechargeable. A textile thread or fibre 204 is wrapped around the element 200 (and the power source 202) and as represented in FIG. 1 the threads or fibres are wrapped helically around the element 200. Clearly more than one thread or fibre beneficially wraps the element 200 and power source 202. Wrapping may alternatively be substantially perpendicular to the longitudinal length of the element and in the embodiment as shown in FIG. 14 there is spacing between the thread as wrapped around the element which enables transmittal of radiation from the element. Alternatively, the wrapping may be configured in order that the thread or fibre has no helical spacing. Wrapping may be achieved by known wrapping techniques such as core wrapping. A control arrangement for example as described in WO02/084617 (not shown) may also be wrapped within the textile thread or fibre 204 configured to control the intensity of the emitted radiation from the element 200 and additionally may be configured to control the intensity of radiation emitted from one or more additional elements.

Figure 15:
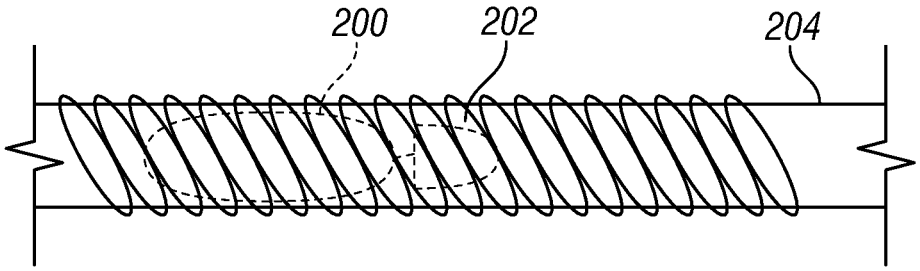
FIG. 15 is a schematic representation of a second exemplary embodiment of the ninth aspect of the present invention.
Figure 16:
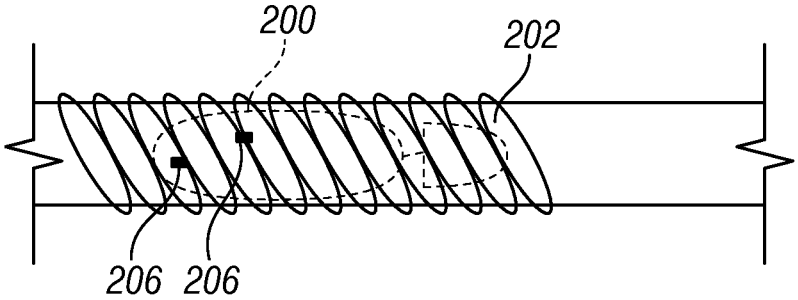
FIG. 16 is a schematic representation of a third exemplary embodiment of the ninth aspect of the present invention.

With reference to FIG. 15, an alternative embodiment of the present invention is shown which comprises an elongate hollow member 204 in which located is the element 200 and power source 202. It will be appreciated that the element 200 and/or power source 202 may be positioned entirely within the core of the elongate member, or alternatively may be fixed to the inner wall of the elongate member 204 or embedded therein. The thread or fibre wrapped around the elongate member 204 is shown in this embodiment in a helical configuration and it will be appreciated that there may be helical spacing in order that there is sufficient infrared radiation emission. Referring to FIG. 16, in an alternative embodiment it will be appreciated that one or more spacing elements such as nodules or protrusions 206 may be provided that protrude at least some distance through the thread or fibre wrapped around the elongate member 204. Such nodules 206 are beneficially located such that radiation emitted from the elements 200 passes through and out of the nodules 206.

The element 200 itself may comprise an emitter which contains a small infrared light emitting diode housed in a shell which may be, for example, injection plastic moulded.

The emitter 200 is connected to a power source such as a battery or alternatively an arrangement as described elsewhere in the present application.

Aspects of the present invention have been described by way of example only and it will be appreciated by the skilled addressee that modifications and variations may be made without departing from the scope of protection afforded by the appended claims.

The invention claimed is:

1. A textile thread or fiber configured to enable fluid flow therethrough, the textile thread or fiber comprising an elongate member having a cavity portion therein, wherein a wall of the elongate member includes one or more apertures therein thereby providing a fluid flowpath from the cavity portion through the wall of the elongate member, and further comprising a fan arrangement substantially located in the cavity portion configured to draw gas through the cavity portion.

2. A textile thread or fiber configured to enable fluid flow therethrough, the textile thread or fiber comprising an elongate member having a cavity portion therein, wherein a wall of the elongate member includes one or more apertures therein thereby providing a fluid flowpath from the cavity portion through the wall of the elongate member, and wherein a thread of a material is at least partly in communication with the cavity of the elongate member, and extends through the wall of the elongate member.

3. A textile thread or fiber according to claim 2 wherein one or more individual fibers are disposed around the elongate member.

4. A textile thread or fiber according to claim 2 wherein the elongate member comprises a polymer.

5. A textile thread or fiber according to claim 3 wherein the one or more individual fibers disposed around the elongate member are wound in a helical configuration.

6. A textile thread or fiber according to claim 2 wherein the one or more apertures are configured to extend helically around the elongate member.

7. A textile thread or fiber according to claim 1 comprising a heat sink in communication with the cavity.

8. A textile thread or fiber configured to enable fluid flow therethrough, the textile thread or fiber comprising an elongate member having a cavity portion therein, wherein a wall of the elongate member includes one or more apertures therein thereby providing a fluid flowpath from the cavity portion through the wall of the elongate member, further comprising a plurality of elements including at least one microprocessor and at least one data memory element located at least partially in the cavity, wherein the plurality of elements are interconnected or otherwise communicating to form a signal processing system.

9. A textile thread or fiber according to claim 8 wherein one or more of the elements are elongate in shape and are aligned lengthwise or helically in the cavity, and/or wherein one or more of the elements are affixed internally or embedded in the wall of the elongate member.

10. A textile thread or fiber according to claim 2 wherein the thread of material extends along the longitudinal length of the elongate member.

11. A textile thread or fiber according to claim 4 wherein the polymer is polyvinyl chloride and/or polyester.

12. A textile thread or fiber configured to enable fluid flow therethrough, the textile thread or fiber comprising an elongate member having a cavity portion therein, wherein a wall of the elongate member includes one or more apertures therein thereby providing a fluid flowpath from the cavity portion through the wall of the elongate member, and comprising an energy conversion device at least partially positioned in the cavity, the energy conversion device comprising a turbine.

13. A textile thread or fiber according to claim 12 wherein the turbine comprises a rotor and a stator and a transfer means for transferring the electrical energy to a predetermined location comprising a change storage device.

14. A textile thread or fiber according to claim 2 wherein the cavity portion includes a fluid therein.

15. A textile thread or fiber according to claim 14 wherein the fluid comprises a liquid refrigerant or an insect repellent or a medication.

16. A textile thread or fiber according to claim 14 wherein a valve arrangement is provided to enable release of the fluid from the cavity portion through the one or more apertures in the elongate member.

17. A textile thread or fiber according to claim 16 wherein a control arrangement is provided to control actuation of the valve arrangement.

18. A textile thread or fiber according to claim 16 wherein the valve arrangement is arranged to be actuated by a predetermined pressure or temperature in the cavity portion.

19. A textile thread or fiber configured to enable fluid flow therethrough, the textile thread or fiber comprising an elongate member having a cavity portion therein, wherein a wall of the elongate member includes one or more apertures therein thereby providing a fluid flowpath from the cavity portion through the wall of the elongate member, and wherein a duct is provided for enabling fluid flow from the aperture in the wall of the elongate member to outside of the elongate member, the duct configured to project at least partially transversely relative to the longitudinal length of the elongate member.

20. A textile thread or fiber according to claim 4 wherein the polymer is polyester.

21. A textile thread or fiber according to claim 10 wherein the thread of material extends along the longitudinal length of the elongate member in a helical configuration.

* * * * *